US011534775B2

(12) United States Patent
Neumayr

(10) Patent No.: US 11,534,775 B2
(45) Date of Patent: Dec. 27, 2022

(54) SHOWER DEVICE

(71) Applicant: Dornbracht AG & Co. KG, Iserlohn (DE)

(72) Inventor: Michael Neumayr, Munich (DE)

(73) Assignee: Dornbracht AG & Co. KG, Iserlohn (DE)

( * ) Notice: Subject to any disclaimer, the term of this patent is extended or adjusted under 35 U.S.C. 154(b) by 0 days.

(21) Appl. No.: 15/751,695

(22) PCT Filed: May 30, 2017

(86) PCT No.: PCT/EP2017/063021
§ 371 (c)(1),
(2) Date: Feb. 9, 2018

(87) PCT Pub. No.: WO2017/207560
PCT Pub. Date: Dec. 7, 2017

(65) Prior Publication Data

US 2019/0076855 A1 Mar. 14, 2019

(30) Foreign Application Priority Data

May 31, 2016 (DE) ..... 10 2016 110 069.2

(51) Int. Cl.

| | |
|---|---|
| ***B05B 1/18*** | (2006.01) |
| ***E03C 1/04*** | (2006.01) |
| ***F21V 33/00*** | (2006.01) |
| *B05B 1/02* | (2006.01) |

(52) U.S. Cl.
CPC ..... *B05B 1/185* (2013.01); *E03C 1/0408* (2013.01); *F21V 33/004* (2013.01); *B05B 1/02* (2013.01)

(58) Field of Classification Search
CPC ..... B05B 1/185; B05B 1/02; B05B 1/262; E03C 1/0408; F21V 33/004
(Continued)

(56) References Cited

U.S. PATENT DOCUMENTS 8,214,935 B2 * 7/2012 Colin ..... B05B 1/323 4/492
8,307,472 B1 11/2012 Saxon et al.
(Continued)

FOREIGN PATENT DOCUMENTS

CN 101954325 1/2011
CN 103657893 3/2014
(Continued)

OTHER PUBLICATIONS

First Office Action for Chinese Patent Application No. 2017880003341.6 dated Jun. 23, 2020 (12 pages) English Translation.
(Continued)

*Primary Examiner* — Christopher S Kim
(74) *Attorney, Agent, or Firm* — Pauly, DeVries Smith & Deffner LLC

(57) ABSTRACT

The disclosure concerns a shower device for creating at least one water jet pattern with a structural assembly, with a nozzle assembly and with a lighting assembly. It is proposed that the structural assembly provides an exit opening for the emergence of the water discharged by the nozzle assembly and has an outer edge region running about the edge of the exit opening, that the exit opening during the shower operation is only partly occupied with emerging water at any given time, that the nozzle assembly is arranged distributed along at least a portion of the edge of the exit opening at the edge region and that the path of the water discharged by the nozzle assembly during the shower operation runs each time from the edge region in the direction of the exit opening and then through the exit opening.

21 Claims, 5 Drawing Sheets

(58) Field of Classification Search
USPC .... 239/499, 502, 504, 518, 520–524, 17, 18
See application file for complete search history.

(56) References Cited

U.S. PATENT DOCUMENTS

| | | | |
|---|---|---|---|
| 9,182,182 | B2 | 11/2015 | Ning et al. |
| 9,221,070 | B2 * | 12/2015 | Andersen ..... B05B 17/085 |
| 9,266,127 | B2 | 2/2016 | Sato et al. |
| 9,573,143 | B2 | 2/2017 | Lin et al. |
| 2015/0028130 | A1 | 1/2015 | Sato et al. |

FOREIGN PATENT DOCUMENTS

| | | |
|---|---|---|
| CN | 204620245 | 9/2015 |
| DE | 20101460 | 7/2001 |
| DE | 202004016297 | 5/2005 |
| DE | 102004001256 | 8/2005 |
| DE | 102004011256 | 9/2005 |
| EP | 2896757 | 7/2015 |
| EP | 2992963 | 3/2016 |
| JP | 2002238793 | 8/2002 |
| WO | 2007101358 | 9/2007 |

OTHER PUBLICATIONS

International Search Report and Written Opinion for PCT/EP2017/063021, dated Sep. 12, 2017 (10 pages).
Office Action from priority application No. DE 10 2016 110 069.2, dated Mar. 15, 2017, 5 pages.

* cited by examiner

SHOWER DEVICE

CROSS-REFERENCE TO RELATED APPLICATIONS

This application is a national stage application under 35 U.S.C. 371 of International Patent Application Serial No. PCT/EP2017/063021, entitled "Shower Device," filed May 30, 2017, which claims priority from German Patent Application No. DE 10 2016 110 069.2, filed May 31, 2016, the disclosure of which is incorporated herein by reference.

FIELD OF THE TECHNOLOGY

The disclosure concerns a shower device for creating at least one water jet pattern, as well as a shower assembly with such a shower device.

BACKGROUND

At present, the creation of at least one water jet pattern with simultaneous creation of lighting effects is a subject of interest. This involves not simply providing a water outlet for physical hygiene, but also a choreography involving water and lighting, which should produce a particular shower experience. This requires a shower device which serves both mentioned aspects in an especially flexible manner.

The known shower device (DE 10 2004 001 256 A1), from which the disclosure starts, comprises a structural assembly, which accommodates both a nozzle assembly and a lighting assembly, but the resulting water jet pattern in view of the nozzle assembly there is confined to the water jet pattern of an ordinary shower, and the lighting on account of the light sources arranged in the visible surface is confined to the lighting effect of an ordinary light source.

SUMMARY

The disclosure proposes to solve the problem of designing and modifying the known shower device so that the flexibility is enhanced in the combined creation of water jet patterns and lighting effects.

First of all, the fundamental consideration is important that a large exit opening, at whose outer edge region a nozzle assembly is arranged, already allows a good flexibility in the creation of the water jet pattern. This edge region is namely suitable for accommodating very different kinds of nozzles of the nozzle assembly, whose water runs each time from the edge region at first in the direction of the exit opening. At the same time, this edge region, inter alia, offers a possible structural space for the positioning of a lighting assembly.

Specifically, it is proposed that the structural assembly provides an exit opening for the emergence of the water discharged by the nozzle assembly and accordingly has an outer edge region running about the edge of the exit opening. It is an interesting fact here that the exit opening is not necessarily fully occupied by emerging water during the shower operation, such as is the case for example with a nozzle opening. Instead, it can be proposed that during the shower operation the exit opening is only partly occupied with emerging water at any given time. Depending on the water jet pattern, this allows a differing occupation of the exit opening with emerging water, which further enhances the flexibility in the creation of the water jet pattern.

Moreover, it is provided in accordance with the proposal that the nozzle assembly is arranged distributed along at least a portion of the edge of the exit opening at the edge region. Thus, the nozzle assembly follows the course of the edge of the exit opening. During the shower operation, the path of the water discharged by the nozzle assembly runs each time from the edge region toward the exit opening and then through the exit opening. Thus, according to the proposal, the water discharged by the nozzle assembly must at first arrive at the exit opening in order to then be able to pass through the exit opening. With this "detour", the good flexibility in the design of the shower device is consciously achieved. At the same time, it has been found that just such a detour results in new water jet patterns which make the proposed shower device one of a kind.

As mentioned above, a corresponding flexibility results for the design of the lighting assembly. In some embodiments, the above exit opening serves not only for the emergence of water, but also for the emergence of at least part of the light which has been generated by the lighting assembly.

Basically, the nozzle assembly may be arranged distributed only along a portion of the edge of the exit opening, as indicated above. In some embodiments, however, the nozzle assembly is arranged distributed along the entire edge of the exit opening, wherein the distribution need not necessarily be uniform, but instead may also be nonuniform. Basically, a distribution of individual groups of nozzles of the nozzle assembly is also conceivable.

From the arrangement of the nozzle assembly along the edge of the exit opening it results that the path of the water discharged by the nozzle assembly runs from several different directions from the edge region to the exit opening, such as each time to the center region of the exit opening, and such as in a star pattern. This grants the possibility of creating a water jet pattern which is symmetrical about a center region of the exit opening.

Various embodiments involve the possibility of creating different water jet patterns by the nozzle assembly having different kinds of nozzles, which are actuatable by means of a valve assembly for creating different water jet patterns.

Various embodiments concern possibilities for the realization of the lighting assembly. In the reflector assembly according to some embodiments, which has a hood-like reflector, with a suitable arrangement of the at least one light source of the lighting assembly it is possible to create an optical depth effect which is further intensified by a corresponding water jet pattern.

Various embodiments concern configurations for the exit opening. With the round exit openings according to some embodiments around the edge of the exit opening it is possible to create steady water jet patterns, while with the polygonal exit openings according to some embodiments entirely new water jet patterns can be created which owe their existence to the corners. It should be considered that at least one corner of the exit opening can be sharp-edged and/or at least one corner of the exit opening can be rounded.

In some embodiments, the nozzle assembly and/or the lighting assembly is/are covered by the edge region and thus not visible thanks to suitable design of the edge region of the exit opening when the shower device is used appropriately. This produces a creative overall impression which cannot be produced with existing shower devices.

Some embodiments include, a shower assembly, in which a shower device according to the disclosure is mounted in or on a ceiling. Reference may be made to all remarks on the proposed shower device.

In various embodiments, the smallest clear internal dimension of the exit opening is of considerable size in relation to the height of the exit opening or the ceiling in or on which the shower device is mounted above the floor. The exceptional size of the exit opening on the one hand produces the aforementioned flexibility in regard to the water jet pattern and the lighting effects and on the other hand in regard to the creative overall impression.

An embodiment provides for a shower device for creating at least one water jet pattern with a structural assembly, with a nozzle assembly and with a lighting assembly, wherein the structural assembly provides an exit opening for the emergence of the water discharged by the nozzle assembly and has an outer edge region running about the edge of the exit opening, wherein the exit opening during the shower operation is in particular only partly occupied with emerging water at any given time, wherein the nozzle assembly is arranged distributed along at least a portion of the edge of the exit opening at the edge region, especially along at least a quarter of the edge of the exit opening, and wherein the path of the water discharged by the nozzle assembly during the shower operation runs each time from the edge region in the direction of the exit opening and then through the exit opening.

In some embodiments, the light generated by the lighting assembly emerges at least for a part, such as substantially, from the exit opening.

In some embodiments, the nozzle assembly is arranged distributed along the entire edge of the exit opening.

In some embodiments, the path of the water discharged by the nozzle assembly runs from several different directions from the edge region to the exit opening, such as to a center region of the exit opening, such as in a star pattern.

In some embodiments, the portion of area through which the water discharged by the nozzle assembly during the shower operation passes through the passage area of the exit opening at any given time is less than 50%, such as less than 40%, or such as less than 20%.

In some embodiments, the nozzle assembly comprises a first group of at least two nozzles of a first kind, such as wherein the nozzle assembly comprises a second group of at least two nozzles of a second kind, and, in some embodiments, wherein the nozzle assembly comprises a third group of at least two nozzles of a third kind.

In some embodiments, the nozzle of the first kind is a splash jet nozzle, and/or wherein the nozzle of the second kind is a single jet nozzle, and/or wherein the nozzle of the third kind is a splash jet nozzle or a single jet nozzle.

In some embodiments, a valve assembly is provided, with which the nozzle assembly can be actuated with water, such as wherein different nozzles of the nozzle assembly, such as nozzles of a different kind, are actuated in dependence on the kind of water jet pattern.

In some embodiments, the nozzle assembly is actuatable by means of the valve assembly so that the water jet pattern produces a splash jet across at least a portion of the edge of the exit opening that emerges from the edge of the exit opening.

In some embodiments, the nozzle assembly can be coordinated with a encircling storage channel, into which the nozzle assembly generally channels water.

In some embodiments, the nozzle assembly is actuatable by means of the valve assembly so that the water jet pattern produces a multitude of single jets across at least a portion of the edge of the exit opening, whose path is a trajectory from the nozzle assembly across the edge region into the exit opening.

In some embodiments, at least a portion of the nozzles of the nozzle assembly, especially the nozzles of the second kind, is/are tilted upward in the mounted condition relative to the horizontal.

In some embodiments, the lighting assembly comprises at least one light source, which is arranged in the edge region of the exit opening, wherein the light source is arranged along at least a segment of the edge of the exit opening, further wherein the lighting assembly can have an LED ribbon which is arranged along at least a segment of the edge of the exit opening.

In some embodiments, the lighting assembly has a reflector arrangement and wherein the light of the lighting assembly is reflected by the reflector arrangement and then emerges through the exit opening, such as wherein the reflector arrangement comprises a hood-shaped reflector, such as wherein the reflector extends across the entire exit opening, or such as wherein the reflector extends across at least a portion of the edge region of the exit opening.

In some embodiments, the exit opening is round in configuration, such as wherein the exit opening is circular round in configuration or wherein the exit opening is elliptical in configuration or wherein the exit opening is configured in the manner of an elongated hole.

In some embodiments, the exit opening is a polygon, such as wherein the exit opening is triangular, square, pentagonal or hexagonal.

In some embodiments, the exit opening is multi-sided, such as wherein the exit opening is three-sided, four-sided, five-sided or six-sided.

In some embodiments, the edge region is funnel-shaped at least for a portion, such as in the segment of the edge region facing the exit opening, and wherein in the mounted condition the funnel-shaped segment of the edge region tapers downward.

In some embodiments, nozzle assembly and/or the lighting assembly are/is arranged so that in the mounted condition when looking at the exit opening, the nozzle assembly and the lighting assembly are not visible due to the arrangement in the edge region of the exit opening, such as wherein the structural assembly comprises a cover, which provides the edge of the exit opening and which hides at least one portion of the nozzle assembly and/or of the lighting assembly, such as wherein the cover is substantially funnel-shaped or substantially ring-shaped.

In some embodiments, the smallest clear internal dimension of the exit opening is at least 150 mm, such as at least 200 mm, such as at least 400 mm, such as at least 500 mm, or such as at least 800 mm.

Some embodiments provide a shower assembly with a shower device as described herein, wherein the shower device is mounted in or on a ceiling.

In some embodiments, the ratio between the smallest clear internal dimension of the exit opening and the height of the exit opening or the ceiling above a floor is greater than 0.05, such as greater than 0.1, such as greater than 0.2, or such as greater than 0.3.

BRIEF DESCRIPTION OF THE DRAWINGS

In the following, the disclosure shall be explained more closely by drawings depicting merely sample embodiments. In the drawings.

DETAILED DESCRIPTION

Figure 1:
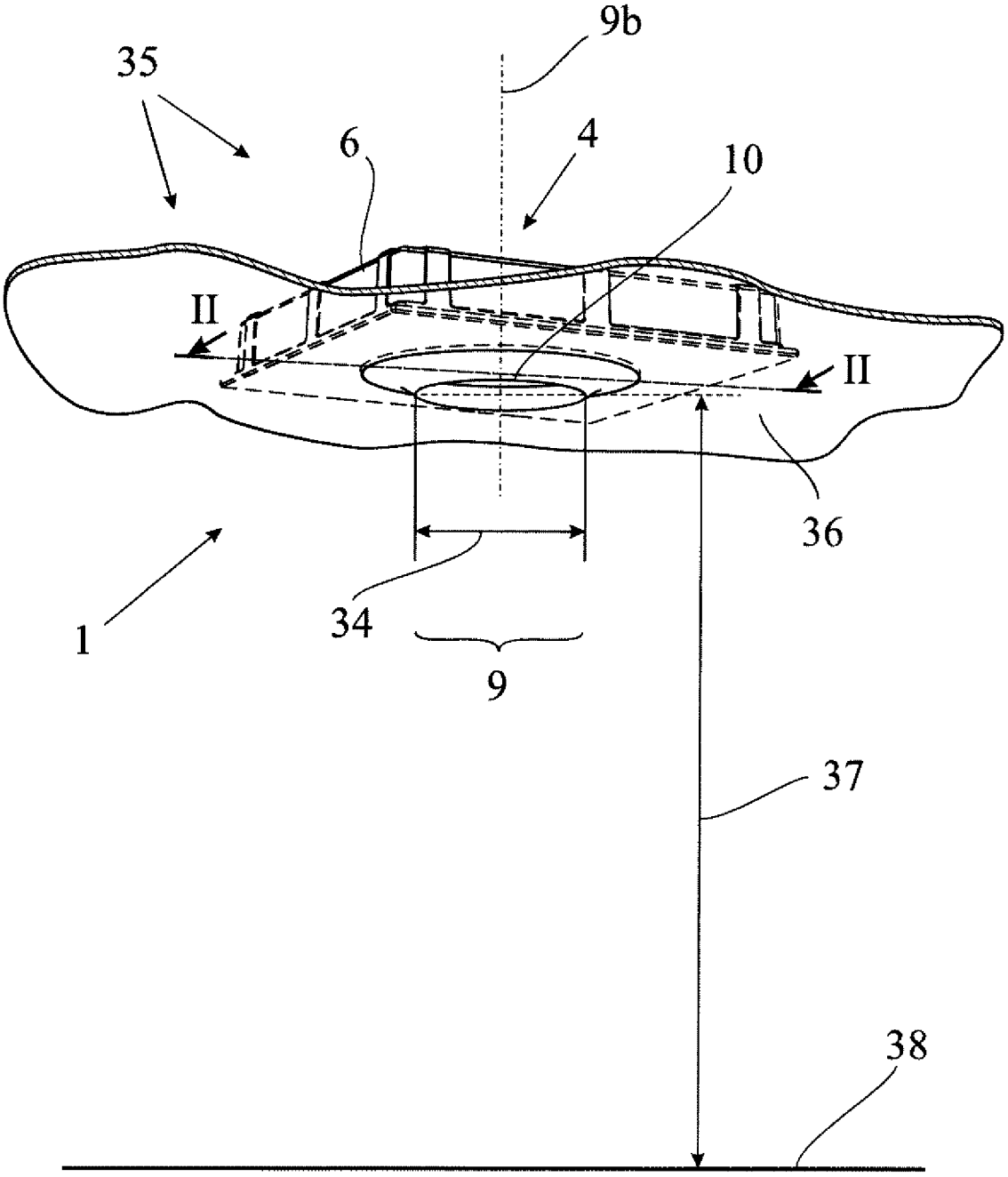
FIG. 1 depicts a shower assembly according to the proposal with a shower device according to the proposal in a perspective view.

The shower device 1 shown in the drawing serves to create at least one water jet pattern 2, 3, as will be explained in further detail below.

The following remarks apply primarily to the embodiment shown in FIGS. 1 to 4. All explanations in this regard hold accordingly for the embodiment according to FIG. 5, whose fundamental structural layout corresponds to the layout of the embodiment shown in FIGS. 1 to 4.

The shower device 1 is outfitted with a structural assembly 4, which determines the structural mechanical layout of the shower device 1. Here, the structural assembly 4 comprises a carrier assembly 5 and a housing 6 to accommodate the carrier assembly 5.

The structural assembly 4 can be formed accordingly from a plurality of components. But it is also conceivable to design the structural assembly 4 as a single piece.

The structural assembly 4 here can be designed to be substantially closed except for the exit opening. In this way, the shower device 1 can be mounted for the most part independently of the particular surrounding circumstances.

In some embodiments, as represented here, the structural assembly 4 is such that the shower device 1 as a whole is designed as a cohesive insert module for ceiling installation. But basically the shower device 1 can also be designed as a cohesive surface-mount module.

The shower device 1 moreover comprises a nozzle assembly 7, which shall be explained later on, with at least one nozzle, such as with at least two nozzles, such as with at least three nozzles, for the dispensing of water W. The dispensing of water W by the nozzle assembly 7 occurs at least for a portion of the nozzle assembly 7 in each case toward the exit opening 9, yet to be explained, in particular toward a center region 16 of the exit opening 9. The term "nozzle" should always be taken in the broader sense in the present document.

Moreover, the shower device 1 comprises a lighting assembly 8, which shall also be explained later on, with at least one light source for putting out light.

Now, it is important that the structural assembly 4 has an already mentioned exit opening 9, here a single exit opening 9, for the emergence of the water W discharged by the nozzle assembly 7. The exit opening 9 forms a clear width for the emergence of water W.

The structural assembly 4 comprises an outer edge region 11 running about the edge 10 of the exit opening 9. As can be seen from the representations according to FIGS. 2 and 3, the edge region 11 in the present instance is defined in that it encircles the exit opening 9. It may be provided here, as shown in FIGS. 2 and 3, that the edge region 11 extends, starting from the edge 10, in a plane which is spaced at an upward distance, in the mounted condition, from the plane which is formed by the edge 10.

The edge region 11 can be formed of a nontransparent material, especially of a plastic material. Thus, it is well suited to hiding the nozzle assembly 7 and/or the lighting assembly 8, as shall be explained.

Figure 2:
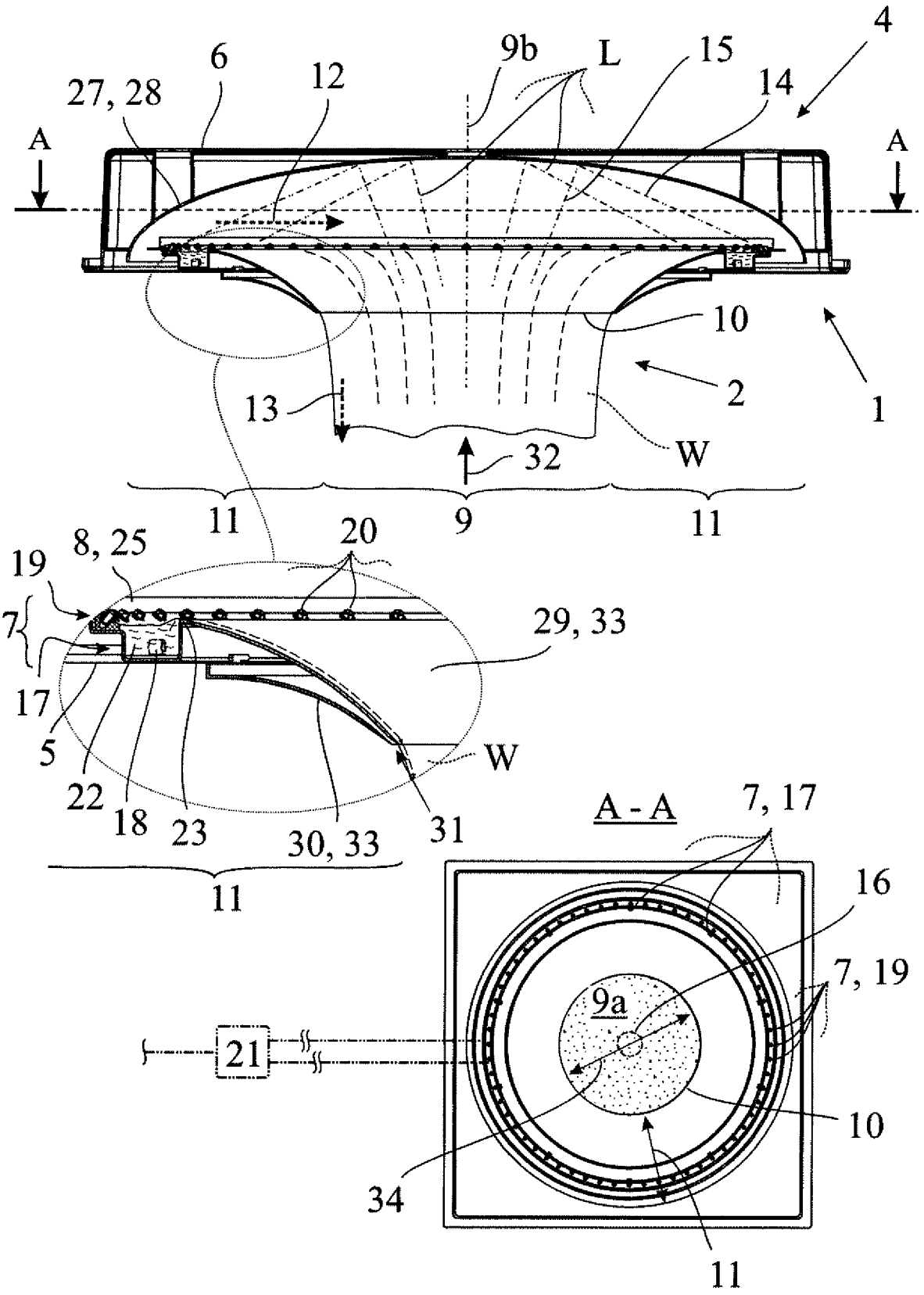
FIG. 2 depicts the shower device from FIG. 1 in a cross-sectional representation along intersecting line II-II during the creation of a first water jet pattern.
Figure 3:
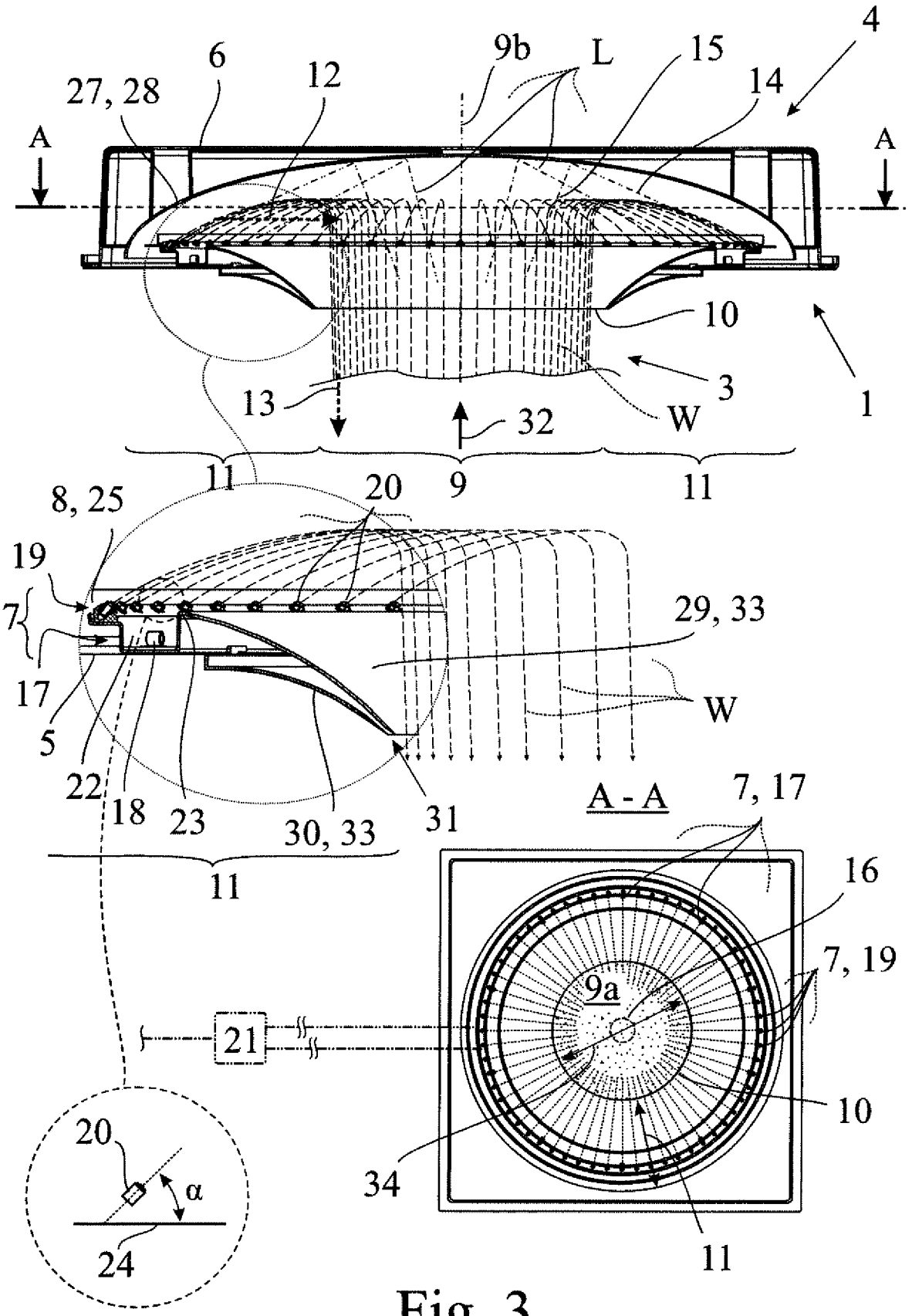
FIG. 3 depicts the shower device according to FIG. 2 during the creation of a second water jet pattern.

FIGS. 2 and 3 show two variants for the shower operation of the shower device 1 according to the proposal, in which different water jet patterns 2, 3 can be created. It becomes clear that, when the two water jet patterns 2, 3 are created, the exit opening 9 is only partly occupied with emerging water W at any given time. This means that the exit opening 9 is much larger than would be needed per se for the emergence of the water produced by the nozzle assembly 7. But this opens up the possibility of creating water jet patterns which cannot be created with the usual, small exit openings 9.

From the cross-sectional view A-A according to FIG. 2 it can be seen that the nozzle assembly 7 is arranged distributed along at least a portion of the edge 10 of the exit opening 9 at the edge region 11 provided by the structural assembly 4. It has already been pointed out that the nozzle assembly 7 follows the course of the edge 10 of the exit opening 9.

In an embodiment, the nozzle assembly 7 is arranged distributed along at least a quarter of the edge 10 of the exit opening 9 at the edge region 11 provided by the structural assembly 4, such as along at least a half of the edge 10 of the exit opening 9. Here it is the case that the nozzle assembly 7 is arranged distributed along the entire edge 10 of the exit opening 9.

Moreover, one sees from FIG. 2 that, during the shower operation, the path of the water W discharged by the nozzle assembly 7 runs each time from the edge region 11 in the direction of the exit opening 9 and then through the exit opening 9. Components of the path of the water W discharged by the nozzle assembly 7 are indicated by the references 12, 13 in FIG. 2.

Furthermore, one sees from the drawing that, in the mounted condition, the emergence of water W from the exit opening 9 in any case has a downwardly directed motion component. Here it is the case that the downwardly directed motion component of the water W is exclusively due to gravity. Thus, the nozzle assembly 7 itself here generates no downwardly directed force component on the water W. Alternatively, it is basically conceivable that the nozzle assembly 7 exerts a downwardly directed force component on the water W, i.e., it brings about a downward acceleration of the water W.

The path of the light L generated by the lighting assembly 8 is indicated by the references 14 and 15 in FIGS. 2 and 3. It is evident from this that here the light L generated by the lighting assembly 8 emerges at least partly, such as substantially, from the exit opening 9. Thus, the exit opening 9 has a dual use, namely, on the one hand for the emergence of water W and on the other hand for the emergence of light L, which simplifies the design layout of the shower device 1.

As shown in FIG. 1, the installation position of the shower device 1 can be substantially horizontal, so that the passage area **9*a* assigned to the exit opening 9 is substantially horizontally directed in the mounted state. The exit opening 9 can be designed symmetrical in regard to an axis of symmetry 9*b*, wherein the axis of symmetry 9*b*** here is oriented substantially vertical, i.e., running from top to bottom.

As mentioned above, the nozzle assembly 7 in the depicted embodiments is arranged distributed along the entire edge 10 of the exit opening 9. Regardless of the dimension of the nozzle assembly 7 along the edge 10 of the exit opening 9, the distribution may be uniform or nonuniform.

FIG. 2 shows that the path 12 of the water W discharged by the nozzle assembly 7 runs from several different directions from the edge region 11 to the exit opening 9, here to a center region 16 of the exit opening 9. The center region 16 here lies in the region of the centroid of the exit opening 9.

FIG. 2 shows that, thanks to the uniform distribution of the nozzle assembly 7 along the edge 10 of the exit opening 9, a star-shape profile for the path 12 results. Depending on the water jet pattern 2, 3, the portion of area through which the water W discharged by the nozzle assembly 7 during the shower operation passes through the passage area 9*a* of the exit opening 9 will change. Basically, the portion of area during the shower operation at any given time may be less than 50%, such as less than 40%, or such as less than 20%. It is clear from the representation according to FIG. 2 that the portion of area 9*a* here is even much less than 20%. In an embodiment, it is the case that only a region of the exit opening 9 near the edge is occupied with emerging water W, at least in the case of a water jet pattern 2 (FIG. 2), so that in any case the center region 16 is free of water W.

Figure 4:
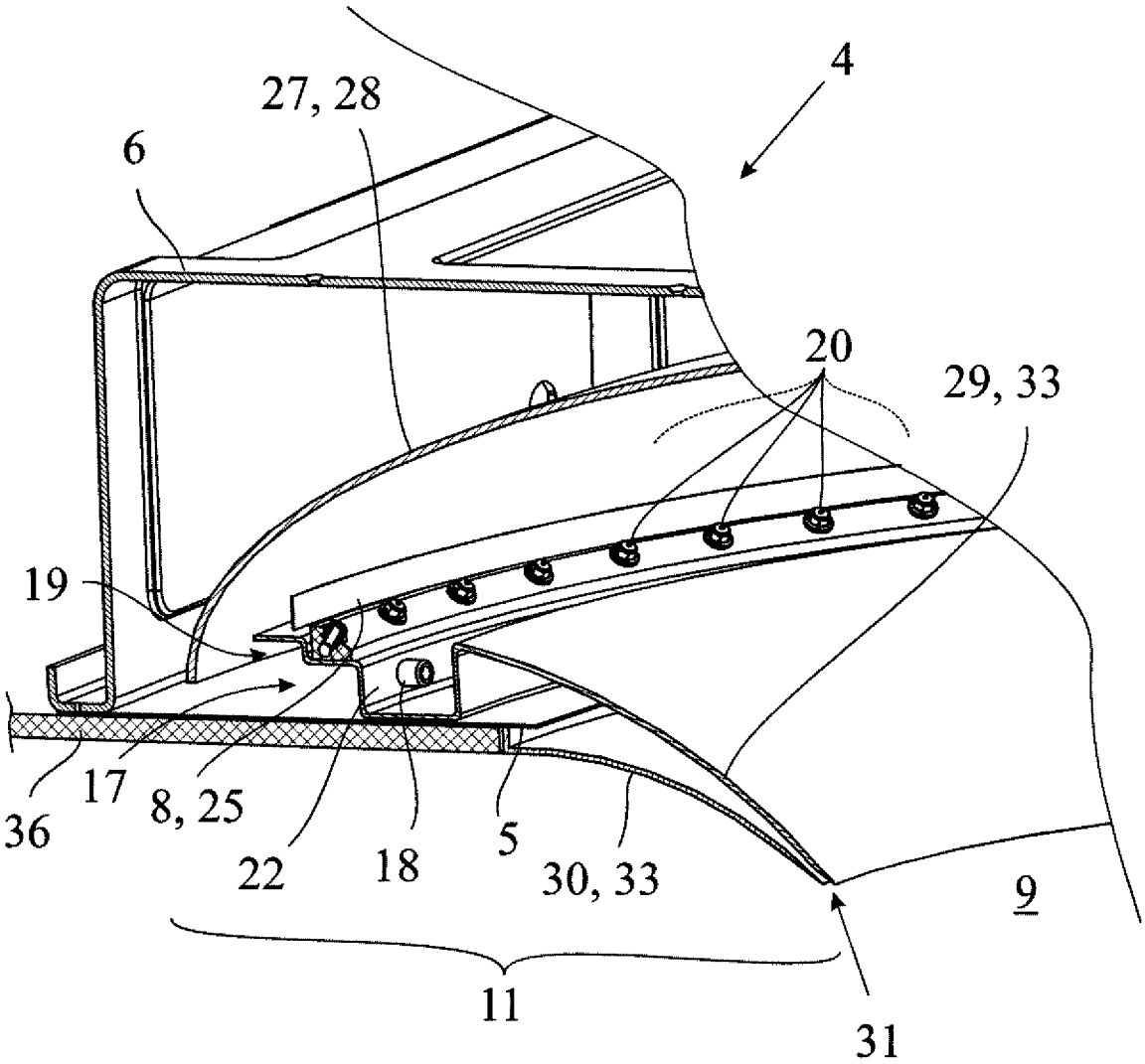
FIG. 4 depicts the shower device according to FIG. 2 in a cutout representation regarding the edge region of the exit opening and FIG. 5 depicts another shower device according to the proposal in a representation according to FIG. 4.

FIGS. 2 to 4 show that the edge region 11 provides a considerable design space for the nozzle assembly 7, so that many different nozzles of the nozzle assembly 7 may be used.

In the depicted sample embodiment, the nozzle assembly 7 comprises a first group 17 of at least two nozzles 18 of a first kind. Here, the first group 17 comprises more than two nozzles 18 of the first kind. In the depicted sample embodiment, the nozzle assembly 7 moreover comprises a second group 19 of at least two nozzles 20 of a second kind. Here, the second group 19 comprises a plurality of nozzles 20 of the second kind. Basically, it is also conceivable, although not represented here, for the nozzle assembly 7 to comprise a third group of at least two nozzles of a third kind, as well as further groups of nozzles of further kinds.

Figure 5:
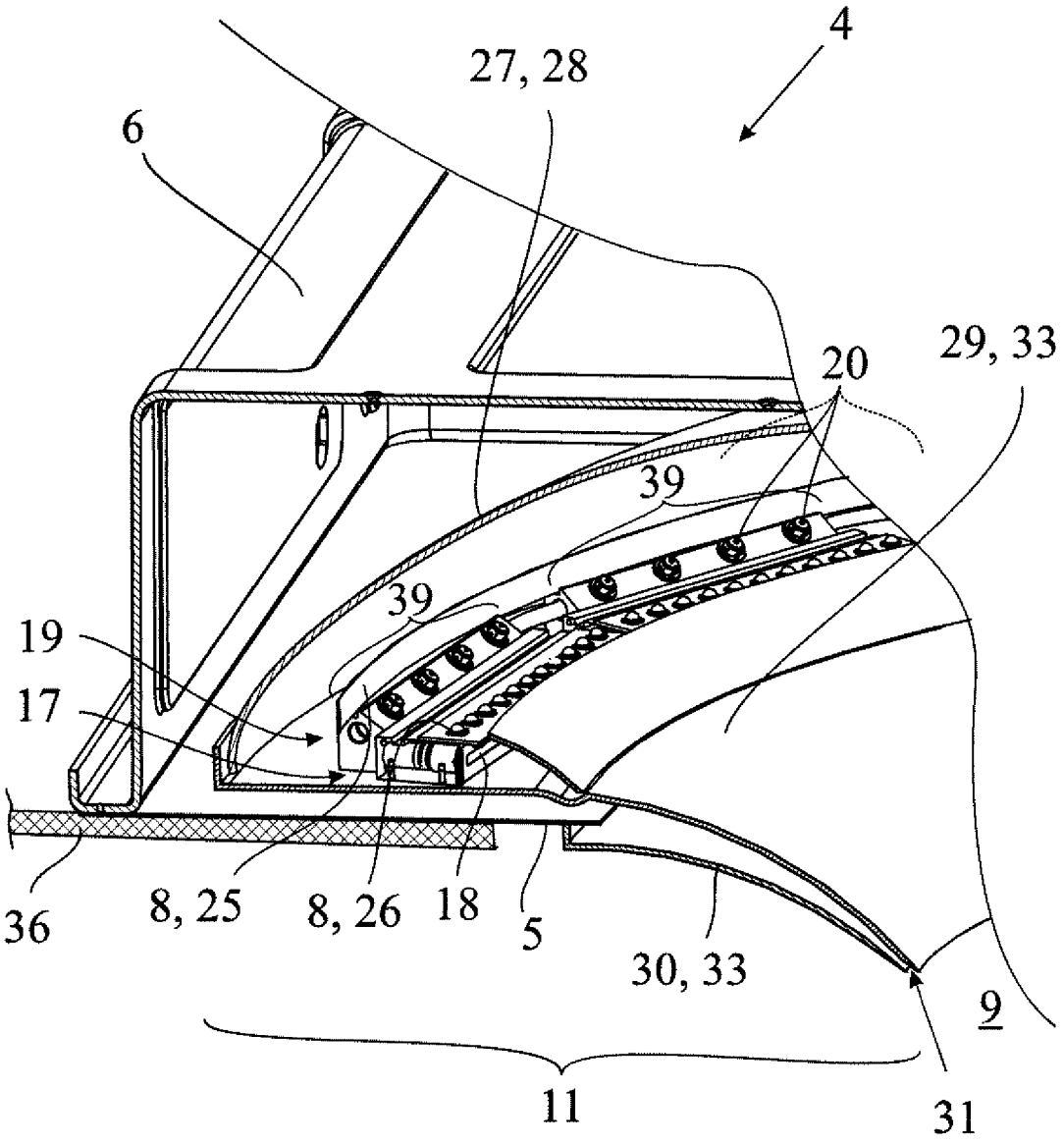

In the depicted sample embodiment, the nozzle 18 of the first kind is quite generally a splash nozzle. In the present case, this means that a single accelerated jet does not emerge from the nozzle 18 of the first kind. In the most simple case, the nozzle 18 of the first kind is a simple hose opening. Alternatively, the nozzle 18 of the first kind may also be a slot nozzle, as shown in FIG. 5.

FIG. 2 shows as an example that a valve assembly 21 is provided, with which the nozzle assembly 7 can be actuated with water W, i.e., impacted with water W, which water W is discharged by the nozzle assembly 7 as mentioned above. In FIGS. 2 and 3, one valve assembly 21 is shown as an example, whose entrance depicted at the left side of the drawing is connected to a water supply and whose exits depicted at the right side of the drawing are connected to the first group 17 of nozzles 18 of the first kind and to the second group 19 of nozzles 20 of the second kind. The nozzle assembly 7 in this regard is hydraulically actuatable by means of the valve assembly 21. The valve assembly 21, in turn, is electrically actuatable by a control assembly, not depicted here.

In an embodiment, different nozzles 18, 20 of the nozzle assembly 7, here nozzles 18, 20 of a different kind, may be actuated in dependence on the kind of water jet pattern 2, 3 desired. Basically, quantities such as water pressure or volume flow can also be adjusted by means of the valve assembly 21 or an additional valve assembly.

For example, the nozzle assembly 7 can be actuated by means of the valve assembly 21 so that the water jet pattern 2 produces a splash jet across at least a portion of the edge 10 of the exit opening 9, emerging from the edge 10 of the exit opening 9. This is shown for example in FIG. 2. Here, the nozzles 18 of the first kind of the nozzle assembly 7 are actuated, i.e., impacted with water W, so that the water W discharged by the nozzle assembly 7 arrives via the edge region 11 at the edge 10 and exits there in the form of a splash jet.

In order to make sure that a uniform splash jet is produced across the edge 10 of the exit opening 9, the nozzle assembly 7 can be coordinated with a storage channel 22, especially an encircling one. The storage channel 22 further can be arranged between the nozzle assembly 7 in general, here between the nozzles of the first kind 18, and the edge 10 of the exit opening 9, into which the nozzle assembly 7 in general, here the nozzles 18 of the first kind, supply water W. The water W moves uniformly across the edge 23 of the storage channel 22, which is the basis for a uniform splash jet across the edge 10 of the exit opening 9. The storage channel 22 in the present instance is part of the nozzle assembly 7 and is accordingly arranged at the edge region 11, distributed along at least one segment of the edge 10 of the exit opening 9, here, across the entire edge 10 of the exit opening 9.

In order to create the water jet pattern 3 which is shown in FIG. 3, the nozzle assembly 7 can be actuated by means of the valve assembly 21 so that the water jet pattern 3 produces a multitude of single jets across at least a portion of the edge 10 of the exit opening 9, whose path is a trajectory from the nozzle assembly 7 across the edge region 11 into the exit opening 9. Only the nozzles 20 of the second kind are actuated with water W here, as likewise shown in FIG. 3.

In order to to be able to realize the above trajectory of the water W, it is provided that at least a portion of the nozzles of the nozzle assembly 7, here the nozzles 20 of the second kind, is/are arranged tilted upward in the mounted condition relative to the horizontal 24. In the depicted sample embodiment, the aforesaid tilting of the nozzles 20 of the second kind relative to the horizontal 24 is provided about an angle $\alpha$ of around 55°. In some embodiments, the angle of tilt $\alpha$ to the horizontal 24 lies in a range between 30° and 80°, or in a range between 40° and 70°.

The lighting assembly 8 can basically comprise several light sources 25, 26. Here, it is the case that the lighting assembly 8 comprises at least one light source 25, which is arranged in the edge region 11 of the exit opening 9. In an embodiment, the light source 25 is arranged along at least a segment of the edge 10 of the exit opening 9. Here, it is the case that the light source 25 is even arranged along the entire edge 10 of the exit opening 9. It can be further provided that the lighting assembly 8 has an LED ribbon as the light source 25, which is arranged along at least a segment of the edge 10 of the exit opening 9. As shown in the representation according to FIG. 2, the LED ribbon here is arranged along the entire edge 10 of the exit opening 9. A further light source 26 is shown in FIG. 5 and shall be explained further below.

Moreover, the lighting assembly 8 may comprise a light source, not shown, which can be situated in the installed state in the region of the exit opening 9, in FIG. 2 above the edge 10 of the exit opening 9, such as above the center region 16 of the exit opening 9. Further light sources of the lighting assembly 8 are conceivable.

In order to realize an indirect illumination of the exit opening 9 as well as of the water W emerging from the exit opening 9, the lighting assembly 8 can be outfitted with a reflector arrangement 27, wherein the light rays of at least one light source 25, 26 of the lighting assembly 8 are reflected by the reflector arrangement 27 and then emerge through the exit opening 9. In the depicted sample embodiment, the reflector arrangement 27 comprises a hood-shaped reflector 28, which here extends across the entire exit opening 9. Further as represented in FIGS. 2 and 3, it can be the case that the reflector 28 extends across at least a portion of the edge region 11 of the exit opening 9, especially across the entire edge region 11 of the exit opening 9. It has already been pointed out that such a reflector arrangement 27 produces an optical depth effect when looking into the exit opening 9.

Both embodiments represented in the drawing have a round exit opening 9, in particular a circular round exit opening 9. Instead of the circular round form of the exit opening 9, an elliptical configuration of the exit opening 9 or a configuration of the exit opening 9 in the manner of an elongated hole can basically be provided. The round configuration enables a steady course of the water jet pattern 2, 3 along the edge 10 of the exit opening 9, as also already explained.

Alternatively, the exit opening 9 may also be a polygon. In some embodiments, the exit opening 9 is then triangular, square, pentagonal or hexagonal. It should be considered here, as indicated above, that at least one corner of the exit opening 9 may be sharp-edged and/or at least one corner of the exit opening 9 may be rounded.

Basically the exit opening 9 may also be multi-sided, wherein the exit opening 9 is three-sided, four-sided, five-sided or six-sided, for example. Such a multi-sided configuration encompasses all shapes of the exit opening 9 for which individual sides may be identified. In some embodiments, at least one of these sides is configured straight for at least a portion.

In one embodiment which is advantageous both in regard to creating the water jet pattern 2, 3 and in a creative respect, the edge region 11 is funnel-shaped at least for a portion, such as in the segment of the edge region 11 facing the exit opening 9, wherein in the mounted condition the funnel-shaped segment 29 of the edge region 11 tapers downward. The funnel-shaped segment 29 forms here a transition segment from the nozzle assembly 7 to the edge 10 of the exit opening 9. In the water jet pattern 2 shown in FIG. 2, a laminar flow is produced from the edge 23 of the storage channel 22 to the edge 10 of the exit opening 9.

The drawing likewise depicts the fact that a further funnel segment 30 is mounted on the above funnel-shaped segment 29 from the bottom, which on the one hand further improves the shower device 1 in a creative aspect. On the other hand, it is conceivable to arrange further nozzles between the two funnel-shaped segments 29, 30, which may contribute to the respective water jet pattern 2, 3 in addition to the proposed nozzle assembly 7 in that the water W discharged by these additional nozzles emerges to the outside through the gap 31 produced between the two funnel-shaped segments 29, 30.

An especially attractive creative overall impression is produced in the depicted sample embodiments in that the nozzle assembly 7 and the lighting assembly 8 are arranged so that in the mounted condition when looking 32 at the visible surface of the shower device 1, especially at the exit opening 9, upward in FIG. 2, 3, the nozzle assembly 7 and the lighting assembly 8 are concealed by the edge region 11 by the assembly in the edge region 11 of the exit opening 9 and thus are not visible. This can basically also be provided only for one of the components, the nozzle assembly 7 and the lighting assembly 8. Thus, the nozzle assembly 1 and/or the lighting assembly 8 are/is advantageously concealed to a person standing underneath the shower device 1.

In order to further improve the aforementioned concealed arrangement of the nozzle assembly 7 or of the lighting assembly 8, it can be provided that the structural assembly 4 comprises a cover 33, which provides the edge 10 of the exit opening 9 and which hides at least one portion of the nozzle assembly 7 and/or of the lighting assembly 8 in the above looking 32 at the visible surface of the shower device 1. Here, the cover 33 is at least partly substantially funnel-shaped and is provided by the two funnel-shaped segments 29, 30. Alternatively, it can also be provided that the cover 33 has other shapes and is substantially ring-shaped, for example. As can be seen in the drawing, the cover 33 here forms part of the aforementioned edge region 11 of the exit opening 9.

The exit opening 9 of the shower device 1 according to the proposal is comparatively large, as already explained above. Here, the smallest clear internal dimension 34 of the exit opening 9 is at least 150 mm, such as at least 200 mm, such as at least 400 mm, such as at least 500 mm, or such as at least 800 mm in a variant suitable for particularly large spaces. Depending on the place of installation, a correspondingly unique overall impression is produced with suitable choice of the exit opening 9.

FIG. 5 shows another embodiment of a shower device 1 according to the proposal in a representation according to FIG. 4. As already explained, the layout of this other shower device 1 corresponds to the layout of the shower device 1 represented in FIGS. 1 to 4.

One feature of the shower device 1 depicted in FIG. 5 is that the nozzle assembly 7 is realized by a plurality of linear strip segments 39, which are arranged along the edge 10 of the exit opening 9. Accordingly, the feature of the distribution of the nozzle assembly 7 along the edge 10 of the exit opening 9 should be interpreted broadly, as indicated above.

Moreover, the nozzles 18 of the first kind are slot nozzles here, whose slots in turn are arranged along the edge 10 of the exit opening 9. This favors the uniform creation of the splash jet along the edge 10 of the exit opening 9 in the case of the water jet pattern shown in FIG. 2. Accordingly, is it also not absolutely necessary in the sample embodiment shown in FIG. 5 to realize a storage channel 22 associated with the nozzle assembly 7 of the kind shown in FIG. 2. The storage channel 22 indicated in FIG. 5 is much more shallow, so that a drainage of the water W remaining in the storage channel 22 after the use of the shower device 1 is no problem.

Finally, it is worthy of note in the sample embodiment shown in FIG. 5 that an additional light source 26 is provided in the form of an illuminant **26*a* distributed along the edge 10 of the exit opening 9, especially LEDs, which beams onto a portion of the water W discharged by the nozzle assembly 7. Here, it is the case that the additional light source 26** beams onto the water W situated on the aforementioned trajectory, so that the water W situated on the trajectory acts as a kind of lightguide. In this way, especially interesting optical lighting effects can be produced.

It may further be pointed out that the shower device 1 according to the proposal can basically have additional nozzle assemblies, which can be designed and arranged in the usual manner. For example, additional nozzles may also be arranged in the visible surface of the shower device 1, without the overall device departing from the proposed teaching.

According to another embodiment, a shower assembly 35 is arranged with a ceiling 37 and a floor 38 and also with a shower device 1 as described herein, wherein the shower device 1 is mounted in or on the ceiling 36 above the floor 37.

The mounting in the ceiling 36 is shown in FIG. 1. The exit opening 9 here lies roughly in the plane of the ceiling 36, which can fundamentally be a suspended ceiling. Reference may be made to all remarks on the device 1 according to the proposal.

The shower device 1 may also be mounted on a ceiling 36 and can be set onto the ceiling 36. It is conceivable that the essential portion of the shower device 1 in the mounted state is arranged offset downward from the ceiling 36.

As mentioned above, special importance is attached to the ratio between the smallest clear internal dimension 34 of the exit opening 9 and the height 37 of the exit opening 9 or the ceiling 36 above a floor 38. Here, the ratio between the smallest clear internal dimension 34 of the exit opening 9 and the height 37 of the exit opening 9 or the ceiling 36 above the floor 38 is greater than 0.05, such as greater than 0.1, such as greater than 0.2, or such as greater than 0.3.

In the case of water jet patterns 2, 3 which exit from the edge 10 of the exit opening 9, there may regularly occur in the course of the downwardly directed path 13 of the water W a point of bundling of the water W, similar to a focal point in optical systems. Here, it is the case that the point of bundling in the proposed shower assembly 35 is situated above the floor 38 on top of which the shower assembly 35 is mounted. This has proven to be advantageous in experiments on the practical use of the particular water jet pattern 2, 3.

The invention claimed is:

1. A shower device for creating at least one water jet pattern comprising:

a structural assembly, a nozzle assembly, a lighting assembly, and a water supply connection;

wherein the water supply connection is coupled to the nozzle assembly and is configured to provide water from an external water supply to the nozzle assembly;

wherein the structural assembly provides an exit opening for an emergence of water discharged by the nozzle assembly and has an outer edge region running about an edge of the exit opening;

wherein the exit opening is configured such that at any given time during the creating at least one water jet pattern the exit opening is only partly occupied with the emerging water;

wherein the nozzle assembly is arranged distributed along at least a portion of the edge of the exit opening at the edge region;

wherein a path of the water discharged by the nozzle assembly during the creating at least one water jet pattern runs each time from the edge region in a direction towards the exit opening and then through the exit opening; and wherein the nozzle assembly comprises a first group of at least two nozzles of a first design, and wherein the nozzle assembly comprises a second group of at least two nozzles of a second design, wherein the first design and the second design are different.

2. The shower device as claimed in claim 1, wherein light generated by the lighting assembly emerges at least in part from the exit opening.

3. The shower device as claimed in claim 1, wherein the nozzle assembly is arranged and distributed along the entire edge of the exit opening.

4. The shower device as claimed in claim 1, wherein the path of the water discharged by the nozzle assembly runs from a plurality of different directions from the edge region to the exit opening.

5. The shower device as claimed in claim 1, wherein a portion of an area through which the water discharged by the nozzle assembly during the creating at least one water jet pattern passes through a passage area of the exit opening at any given time is less than 50%.

6. The shower device as claimed in claim 1, wherein at least one nozzle of the two nozzles of the first design is a splash jet nozzle, and/or wherein at least one nozzle of the two nozzles of the second design is a single jet nozzle.

7. The shower device as claimed in claim 1, further comprising a valve assembly, with which the nozzle assembly is configured to be actuated with water, wherein a portion of a plurality of nozzles of the nozzle assembly is actuated to affect the water jet pattern.

8. The shower device as claimed in claim 7, wherein the nozzle assembly is actuatable by the valve assembly so that the water jet pattern produces a splash jet across at least a portion of the edge of the exit opening that emerges from the edge of the exit opening.

9. The shower device as claimed in claim 7, wherein the nozzle assembly is coordinated with an encircling storage channel, into which the nozzle assembly generally channels water.

10. The shower device as claimed in claim 7, wherein the nozzle assembly is actuatable by the valve assembly so that the water jet pattern produces a multitude of single jets across at least a portion of the edge of the exit opening, whose path is a trajectory from the nozzle assembly across the edge region into the exit opening.

11. The shower device as claimed in claim 1, wherein the nozzle assembly comprises a plurality of nozzles, wherein at least a portion of the plurality of nozzles of the nozzle assembly is tilted upward in the mounted condition relative to the horizontal.

12. The shower device as claimed in claim 1, wherein the lighting assembly comprises at least one light source, which is arranged in the edge region of the exit opening, wherein the light source is arranged along at least a segment of the edge of the exit opening.

13. The shower device as claimed in claim 1, wherein the lighting assembly has a reflector arrangement and wherein the light of the lighting assembly is reflected by the reflector arrangement and then emerges through the exit opening, wherein the reflector arrangement comprises a hood-shaped reflector.

14. The shower device as claimed in claim 13, wherein the reflector arrangement extends across the entire exit opening, or wherein the reflector arrangement extends across at least a portion of the edge region of the exit opening.

15. The shower device as claimed in claim 1, wherein the exit opening is round in configuration.

16. The shower device as claimed in claim 1, wherein the edge region is funnel-shaped at least for a portion and wherein in the mounted condition the funnel-shaped edge region tapers downward.

17. The shower device as claimed in claim 1, wherein the nozzle assembly and/or the lighting assembly are/is arranged so that in the mounted condition when looking at the exit opening, the nozzle assembly and the lighting assembly are not visible due to an arrangement in the edge region of the exit opening.

18. The shower device as claimed in claim 17, wherein the structural assembly comprises a cover, which provides the edge of the exit opening and which hides at least one portion of the nozzle assembly and/or of the lighting assembly, wherein the cover is substantially funnel-shaped or substantially ring-shaped.

19. The shower device as claimed in claim 1, wherein a smallest clear internal dimension of the exit opening is at least 150 mm.

20. A shower assembly with a shower device as claimed in claim 1, wherein the shower device is mounted in or on a ceiling.

21. The shower assembly as claimed in claim 20, wherein the ratio between a smallest clear internal dimension of the exit opening and a height of the exit opening or the ceiling above a floor is greater than 0.05.

* * * * *